United States Patent [19]

Yapp

[11] Patent Number: 4,946,348

[45] Date of Patent: Aug. 7, 1990

[54] CENTRIFUGAL FAN WITH AIRFOIL VANES IN ANNULAR VOLUTE ENVELOPE

[75] Inventor: Martin G. Yapp, Needham, Mass.

[73] Assignee: Airflow Research & Manufacturing Corporation, Watertown, Mass.

[21] Appl. No.: 437,324

[22] Filed: Nov. 17, 1989

Related U.S. Application Data

[63] Continuation of Ser. No. 310,827, Feb. 14, 1989, abandoned.

[51] Int. Cl.[5] ..... F04D 29/44

[52] U.S. Cl. ..... 415/211.2; 416/223 B

[58] Field of Search ..... 415/208.1, 208.2, 209.1, 415/211.2, 181, 182.1, 185, 187; 416/223 B, DIG. 5

[56] References Cited

U.S. PATENT DOCUMENTS

| | | | |
|---|---|---|---|
| 2,923,461 | 2/1960 | Dallenbach | 415/210 |
| 3,117,770 | 1/1964 | Campbell | 415/210 |
| 3,173,604 | 3/1965 | Sheet et al. | 415/209 |
| 3,584,968 | 6/1971 | Keith | 415/210 |
| 3,597,117 | 8/1971 | Zoehfeld | 417/354 |
| 3,936,225 | 2/1976 | Stjernstrom | 415/210 |
| 4,269,571 | 5/1981 | Shikutani et al. | 415/210 |

FOREIGN PATENT DOCUMENTS

| | | | |
|---|---|---|---|
| 1157902 | 11/1983 | Canada . | |
| 2210271 | 9/1973 | Fed. Rep. of Germany . | |
| 51996 | 3/1982 | Japan | 416/178 |
| 202334 | 11/1983 | Japan | 415/210 |
| 2080879 | 2/1972 | United Kingdom . | |
| 1426503 | 3/1976 | United Kingdom . | |
| 1473919 | 5/1977 | United Kingdom . | |
| 1483455 | 8/1977 | United Kingdom . | |
| 2063365 | 6/1981 | United Kingdom . | |
| 2166494 | 5/1986 | United Kingdom . | |

*Primary Examiner*—Robert E. Garrett
*Assistant Examiner*—John T. Kwon
*Attorney, Agent, or Firm*—Fish & Richardson

[57] ABSTRACT

A rearwardly curved centrifugal blower having an annular envelope around the impeller, so that the rotating impeller draws air in through a central inlet and forces it radially outward into the envelope and out of an annular discharge. Multiple airfoil vanes are positioned in the annular envelope, in two axially displaced stages. The vanes are angled to turn and diffuse airflow entering the envelope.

8 Claims, 4 Drawing Sheets

CENTRIFUGAL FAN WITH AIRFOIL VANES IN ANNULAR VOLUTE ENVELOPE

This is a continuation of co-pending application Ser. No. 310,827 filed on Feb. 14, 1989, now abandoned.

BACKGROUND OF THE INVENTION

This invention relates to centrifugal blowers and fans.

Centrifugal blowers and fans generally include an impeller that rotates in a predetermined direction in a housing, and may be driven by an electric motor. The impeller has curved blades which draw air in axially, along the impeller's axis of rotation, and discharge air radially outwardly. Such blowers are used in a variety of applications, which dictate a variety of design points for pressure difference, airflow volume, motor power, motor speed, space constraints, inlet and outlet configuration, noise, and manufacturing tolerances.

One important design feature in a centrifugal fan is the angle of the blade tip relative to a tangent to the tip. This angle is called the "blade exit angle". If the blade exit angle is greater than 90°, the impeller is said to have forwardly curved blades; if the blade exit angle is less than 90°, the impeller is said to have rearwardly curved blades.

Specific centrifugal blowers described in prior patents are discussed below.

Koger et al., U.S. Pat. No. 4,526,506 and DE No. 2,210,271 disclose rearwardly curved centrifugal blowers with a volute.

GB No. 2,080,879 discloses a rearwardly curved centrifugal blower with stator vanes to convert radial flow to axial flow.

Zochfeld, U.S. Pat. No. 3,597,117 and GB No. 2,063,365 disclose forwardly curved centrifugal blowers with a volute.

Calabro, U.S. Pat. No. 3,967,874 discloses a blower 16 positioned in a plenum chamber 14. The blade configuration and blower design are not apparent, but opening 46 in the bottom of the plenum chamber is in communication with the blower outlet.

GB No. 2,166,494 discloses a centrifugal impeller in a rotationally symmetrical cone-shaped housing, with guide vanes to produce an axial discharge.

GB No. 1,483,455 and GB No. 1,473,919 disclose centrifugal blowers with a volute.

GB No. 1,426,503 discloses a centrifugal blower with dual openings.

Shikatani et al., U.S. Pat. No. 4,269,571 disclose a centripetal blower, which draws air in axial entrance 26 and out of the top periphery of disc 22 and axial exit 27 (3:26-36).

Canadian No. 1,157,902 discloses a rearwardly curved centrifugal blower with a curved sheet-metal guide.

SUMMARY OF THE INVENTION

The invention features a rearwardly curved centrifugal blower having an annular envelope around the impeller, so that the rotating impeller draws air in through a central inlet and forces it radially outward into the envelope and out of an annular discharge. Multiple airfoil vanes are positioned in the annular envelope, in two axially displaced stages. The vanes are angled to turn and diffuse airflow entering the envelope.

In preferred embodiments, the blower comprises means for attaching a flow resistance element (e.g. a heat exchanger) at the annular discharge. The annular envelope is thin (e.g. its inner diameter is at least 80% of its outer diameter). The blower has a blade design and rotational velocity design range which generates flow entering the annular envelope at an angle between 60° and 70° with respect to the blower (impeller) axis. The airfoil vanes turn the flow in the envelope to produce a flow at the discharge at an angle between 0° and 10° with respect to the blower axis. At the rotational velocity design point, flow enters the annular envelope at a rate between 50 and 100 feet/sec.; the vanes are sized and positioned to diffuse flow in the envelope to produce a discharge flow rate of between 10 and 40 feet/sec.

The airfoil vanes of the invention significantly enhance efficiency by converting tangential velocity into static pressure. In fact, in preferred embodiments, the tangential velocity energy is essentially fully extracted in the form of pressure, so that the aiflow leaving the discharge has essentially no residual tangential velocity. The resulting design is also relatively quiet. The heat exchanger (e.g. an automobile air conditioning evaporator) downstream of the discharge provides significant flow resistance; airflow through the heat exchanger is substantially more efficient as a result of the uniform axial flow at the discharge. The invention also enables a relatively compact package.

Other features and advantages of the invention will be apparent from the following description of the preferred embodiment.

DESCRIPTION OF THE PREFERRED EMBODIMENT

The following description of the preferred embodiment is provided to illustrate the invention and not to limit it. The description includes features described and claimed in my commonly owned U.S. patent application filed this day entitled, Centrifugal Fan With Variably Cambered Blades, which is hereby incorporated by reference.

STRUCTURE OF THE BLOWER GENERALLY

Figure 1:
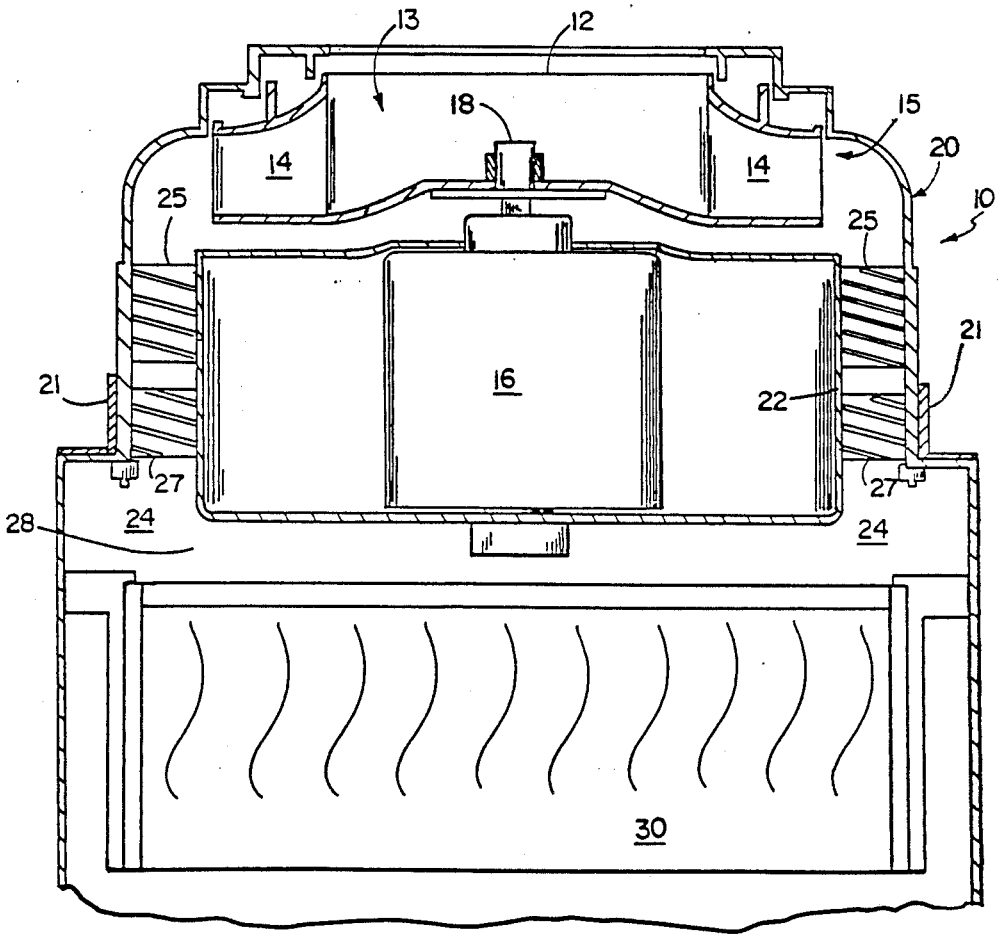
FIG. 1 is a cross-section of a centrifugal blower and automobile air conditioner evaporator.

In FIG. 1, blower 10 includes an impeller 12 consisting of a plurality of blades (14 and 15, shown in FIG. 2) which are described in greater detail below. Impeller 12 is driven by an electric motor 16 attached to impeller axle 18.

Impeller 12 rotates within stator 20, which is a part of generally cylindrical housing 21 extending co-axially with impeller 12 and motor 16. Generally cylindrical motor housing 22 forms the inner diameter of annular envelope 24. The outer diameter of annular envelope 24 is established by housing 21.

AIRFOIL VANES

Figure 3:
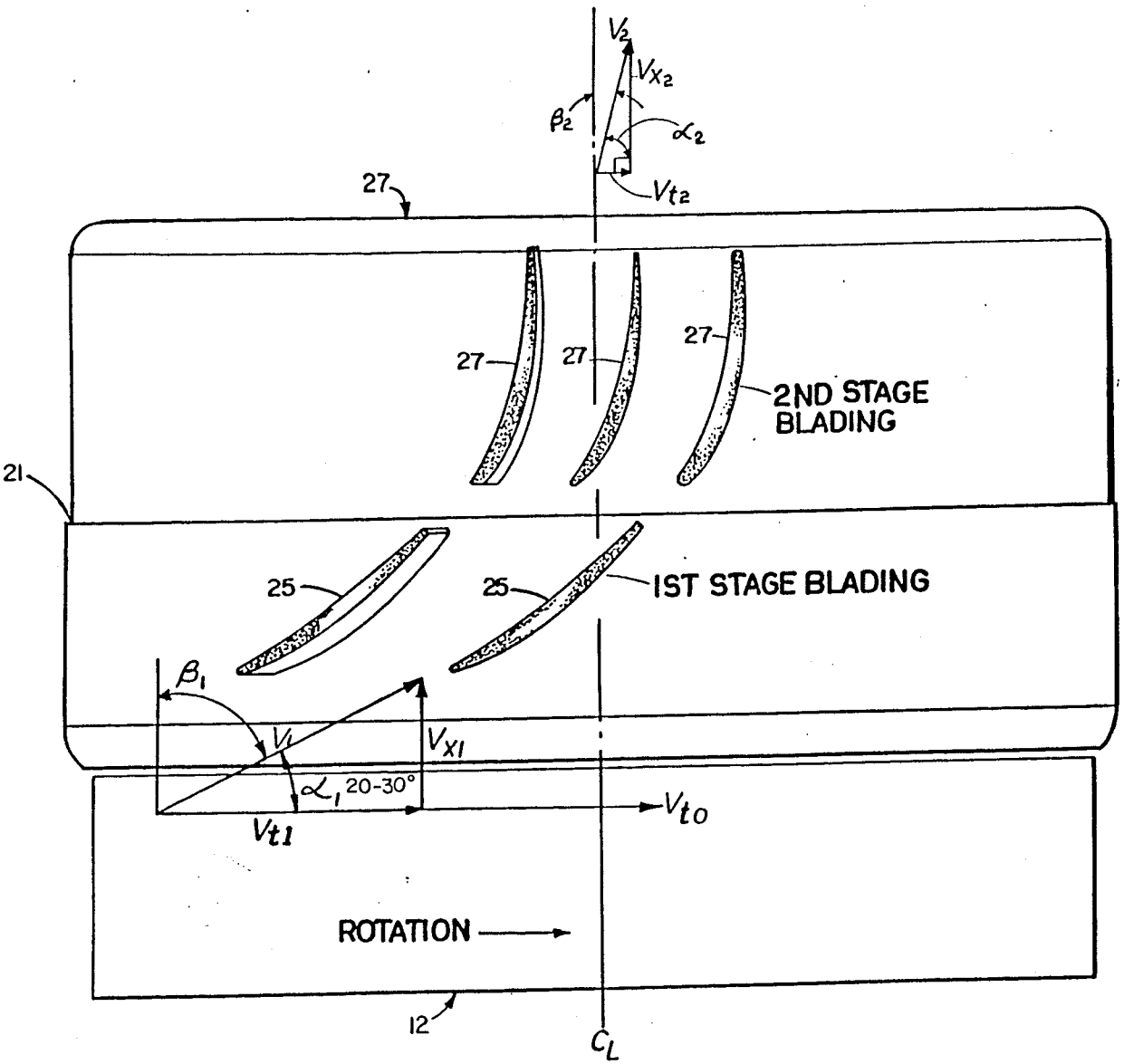
FIG. 3 is a top view, partially broken away, of the annular envelope of the blower of FIG. 1.

Positioned within annular envelope 24 are two sets 25 and 27 of airfoil vanes shown best in FIG. 3. $C_L$ is the centerline (axis) of the motor, blower and impeller. The vanes extract tangential (rotational or swirl) velocity from air leaving the impeller, and they recapture that energy as static pressure.

Evaporator 30 is attached to the outlet 28 of envelope 24. Swirl in the airflow reaching evaporator 30 is substantially eliminated and air pressure across the evaporator is increased. Specifically, the vanes 25 and 27 are important in part because about ¼ to ½ of the flow energy produced by a rearwardly curved centrifugal blower s in the form of velocity; the airfoil vanes recapture a substantial (40–80%) percentage of this flow energy.

Efficiency of the blower in the form of uniformity of discharge velocity and flow energy recapture is aided by the design of the annular envelope, which is radially symmetrical and smoothly curved. Moreover, the radial extent of the envelope is small, so that the pressure and velocity are relatively uniform across the exit.

Figure 4:
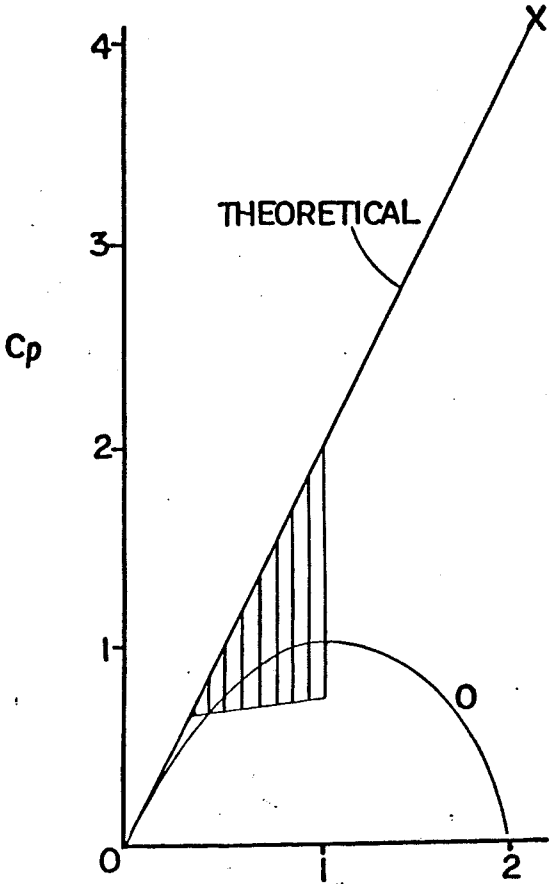
FIG. 4 is a graph of pressure as a function of tangential swirl velocity.

The pressure/swirl regime in which the blower operates is demonstrated by FIG. 4 which diagrams pressure coefficient (Cp) as a function of tangential swirl velocity ($V_t$). In FIG. 4, Cp is defined by the following equation:

$$Cp = \tfrac{1}{2}\rho V^2 \div \tfrac{1}{2}\rho V_{tip}^2$$

In this equation, V is airflow velocity leaving the impeller, and $V_{tip}$ is the impeller tip velocity. Vt* is the tangential velocity of air leaving the impeller $\div V_t$. The theoretical relationship with (x) and without (o) swirl recovery is shown. Blowers of the invention preferably operate within the cross-hatched area where $V_t = 0.5$–1 and Cp=0.5–2.

Those skilled in the art will understand that the exact angle of airfoil vanes 25 and 27 will depend upon the blade configuration (discussed below) and the rotational velocity of the impeller (i.e., the range of rotational velocity within which the blower is designed to operate). It is desirable to match the leading edge of the airfoil to the direction of airflow encountering that leading edge, so that the angle of incidence is negligible. In general, air approaches envelope 24 at an angle of 20–30° from tangential in the regime described above.

It is also desirable to maintain a substantially constant cross sectional area of the airflow (along the blower axis). To this end, there is a reduction in hub diameter at the second stage of stators (indicated by 29 in FIG. 1) to match the reduced cross sectional area created by the higher density of stators in the second stage.

Superimposed on FIG. 3 is a vector diagram for flow $V_1$ entering the stator, in which $V_{t1}$ is the tangential swirl velocity entering the stator, and $V_{x1}$ is the axial velocity of the airstream entering the stator. $V_{to}$ is the tangential velocity of the blower wheel (impeller). Angle $\alpha_1$ is 20°–30° and angle $\beta_1$ is 60–70°. Similar diagrams could be drawn for flow leaving stage 1 and entering stage 2, and for flow leaving stage 2. For flow $V_2$ leaving stage 2, the angle $\alpha_2$ between $V_{t2}$ and $V_{x2}$ would be 80–90° and angle $\beta_2$ is between 0° and 10°. The net effect is that $V_2 << V_1$ because of the change in flow angle, even though $V_{x1} = V_{x2}$.

The second stage is necessary because the boundary layer loading value for a single stage exceeds the maximum engineering value (0.6) associated with attached flow. In this context, the diffusion factor is defined as $(1-V_2/V_1)+(V_{t1}-V_{t2})/2\rho V_1$, where $V_1$ and $V_2$ are respective airflow velocities entering and leaving the stage, $V_{t1}$ and $V_{t2}$ are respective tangential velocities entering and leaving the stage, and $\rho$ is blade solidity (i.e., blade chord ÷ blade spacing).

IMPELLER BLADES

Figure 2A:
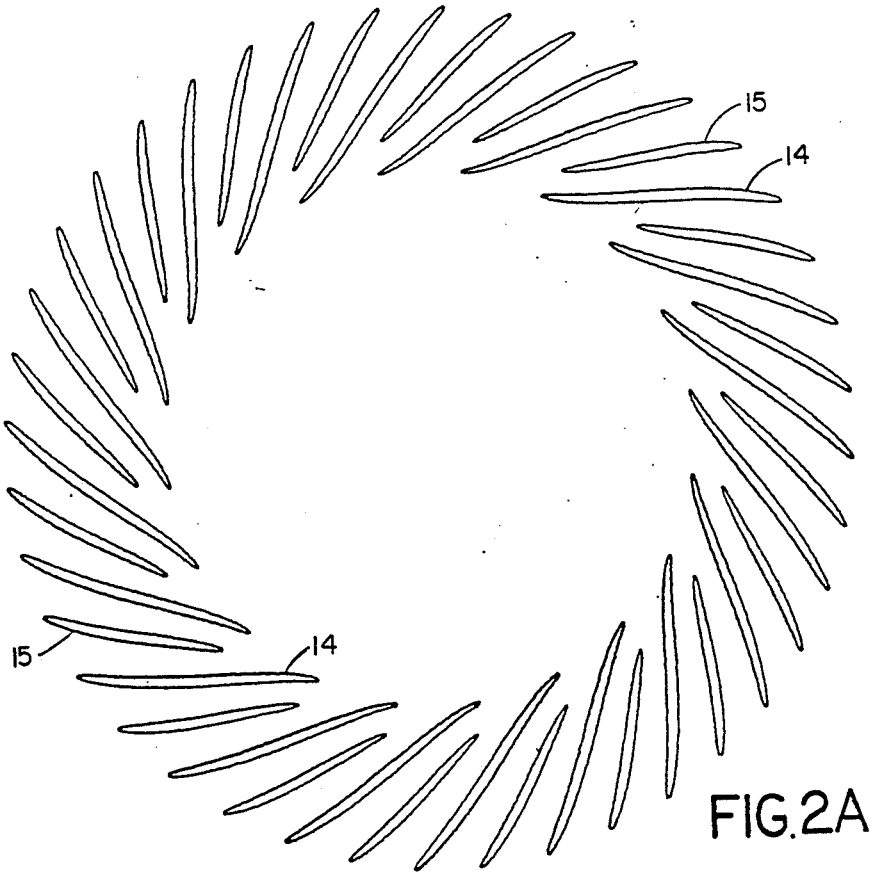
FIG. 2A is a cross-sectional representation of the impeller blades of the blower of FIG. 1.
Figure 2B:
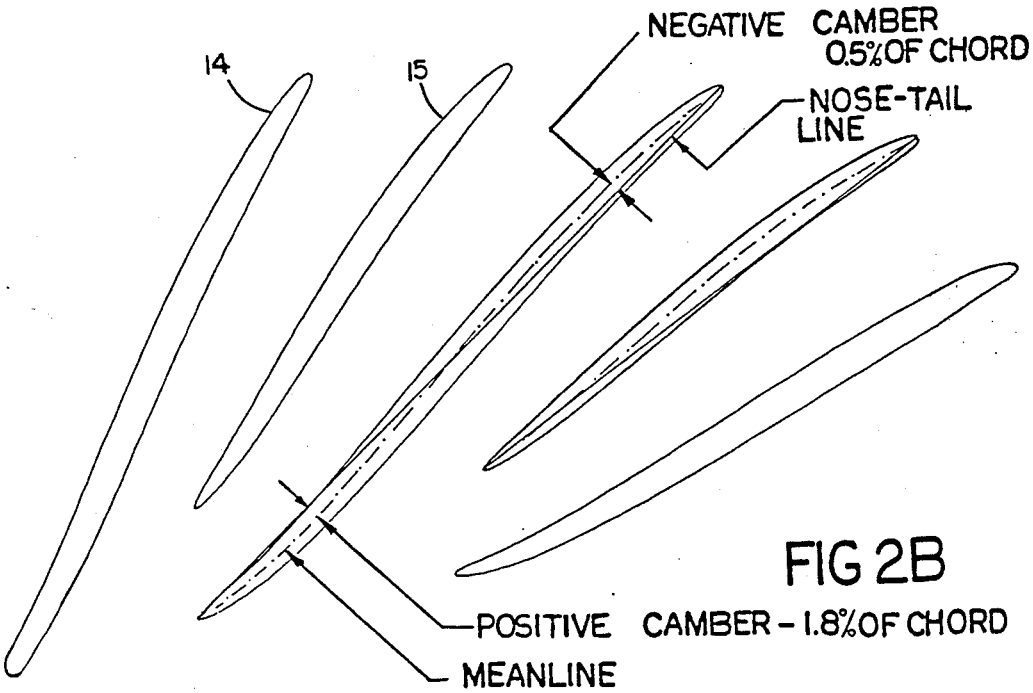
FIG. 2B is an enlarged detail of a portion of FIG. 2A.

FIGS. 2A and 2B are cross-sectional representations of the blades 14 and 15 of the invention, showing their "S" shape (i.e. their reverse camber). The blades are backwardly curved, and (given their relatively small size) develop large thrust or pressure, with good efficiency and low noise. Specifically, FIGS. 2A and 2B shows the "S" shape of long chord blades 14 and shorter chord auxiliary blades 15.

One significant problem in the design of a high thrust backward curved blower is to maintain attached flow on the suction side of the blades all the way from the leading edge to the trailing edge (that is, the blower outside diameter). Boundary layer separation leads to a deviation between the geometric camber lines of the blower blades and the actual flow streamlines. This deviation translates directly into reduced performance since the diffusion process (changing velocity energy into pressure) stops at the point that boundary layer separation occurs. The deviation between the blades and streamlines also leads directly to lower performance by reducing the tangential velocity of the discharge flow.

Maintaining attached flow requires preserving the blade suction surface boundary layer energy as it dissipates along the blade chord. The suction side boundary layer must overcome three significant retarding forces: acceleration associated with the inertial reference frame curvature of the blade surface, a pressure gradient caused by the pressure rise that occurs from the blade leading edge to its trailing edge, and friction that exists at the blade-air interface. It is as though the air were rolling up hill; the air in the boundary layer begins its journey with a certain kinetic energy budget, which is partially dissipated by friction and partially converted into potential energy. At the same time the air follows a curved path, and the momentum change associated with this curvature thickens the boundary layer.

Energy is infused into the boundary layer by the main flow, but less effectively as the thickness of the layer increases. Eventually the retarding forces become greater than the lift forces and the flow separates, that is, diverges from the blade surface. At this point the loss effects described above go into effect.

The blower design of the invention has a combination of high positive camber near the leading edge and apparent negative camber between midchord and the training edge. Thus the blade pulls hard on the flow when the boundary layer attachment is energetic, and pulls gently when the boundary layer attachment is weak. Pulling hard on the flow early produces room for more primary blades; reducing the boundary layer forces proportionately since the net work done by the blower is distributed over all of the blades surface.

In addition, space is produced for intermediate blades with shorter chords, reducing negative lift related BL forces again. The camber lines of these short blades mimic the primary blades in the region where the short blades exist. They could have (but need not have) the "S" shape of the primary blades.

Specifically, the blade configuration of a centrifugal blower is selected using, among other things, knowledge of the following characteristics of blowers:

1. The pressure capacity of a blower increases as the square of the blade tip's tangential velocity at its outside diameter. This velocity is the product of diameter times rotation velocity. Thus, the pressure required by the application largely determines blower speed and diameter.

2. The pressure generated in the blading increases, in theory, to a maximum when the blade exit angle is 90 degrees, as shown in FIG. 4. However, the pressure observed experimentally reaches a maximum when the blade exit angle is still backward curved, at an angle of perhaps 50–60 degrees. Essentially, the 2-dimensional geometry of the blades defines a diffusion passage which has its largest total diffusion when the blade exit angle is 90 degrees. Boundary layer physics prevents realizing this maximum diffusion.

3. The velocity of the air discharged by the blower increases as the blade exit angle increases, and reaches a maximum at a blade exit angle well beyond 90 degrees. The energy invested increases as the square of velocity. In applications where static pressure is required, it can be extracted from a high velocity discharge flow by diffusion. The efficiency of the diffusion process is generally far higher in the blading of the blower than in any process which diffuses the discharge flow—as high as 90 percent for the blading process, versus about 50 percent for the discharge process. It follows that the most efficient blower generally is the one which accomplishes the most diffusion in the blading. However, the blower blade design described herein accomplishes the combination of high efficiency along with small diameter and lower rotational velocity (leading to lower noise).

4. For low noise and best blade diffusion it is necessary to align the blade leading edge with the flow. Thus, the blade entry angle is defined by the RPM, the inlet diameter and leading edge blade span, and the flow design point ($ft^3$/min.).

Figure 5:
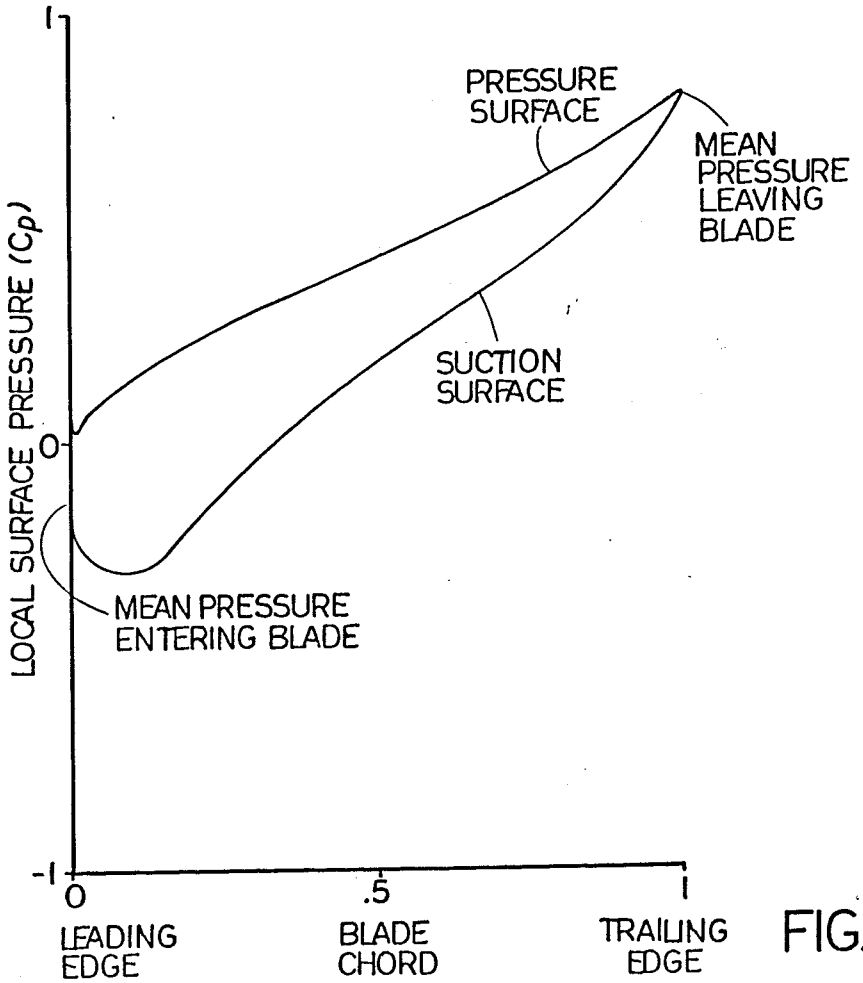
FIG. 5 is a plot of local surface pressure as a function of blade chord position.

FIG. 5 is a plot of local surface pressure (Cp) versus the blade chord position (designated as a percentage of total chord from 0 at the leading edge to 1 at the trailing edge), where Cp is defined by the following equation, in which $P_s$ is the surface pressure and $V_{tip}$ is the tip velocity:

$$Cp = P_s \div \tfrac{1}{2}\rho(V_{tip})^2$$

The plot of FIG. 5 is base a computer model of performance of the primary blades alone. The lower plot represents local surface pressure on the suction surface, and the upper plot represents local surface pressure on the pressure surface. The overall work done is represented by the difference between the average pressure entering the blade (left axis, one-half way between the two plots) and the average pressure leaving the blade (right axis, convergence of the two plots) The plot in FIG. 5 represents a flow of 240 cubic feet per minute, a static pressure of 2.29 and a static efficiency of 0.46.

The "S" shaped blade of the invention pulls hard, as indicated in FIG. 5 by the ΔCp from the high pressure side of the blade to the suction side of the blade, in the chord region 0.0–0.4. For the chord region 0.4–1.0, the blade does less work.

More specifically, the blades have a high positive camber near the leading edge and a negative camber at some point between the mid-point and the tail of the blade. Most preferably the positive camber reaches a maximum of 1–3% in the leading half (e.g. 20–30%) of the blade, and the negative camber is 0.25%–3% in the trailing half (e.g. 70–80%) of the blade.

The operating regime of the blower is further defined by the flow number (J) and the pressure number ($K_t$) as follows:

$$J = \frac{CFM \cdot .0212}{n \cdot D^3}$$

$$K_t = \frac{1700 \cdot \text{static pressure}}{n^2 \cdot D^2}$$

In the above equations, n=rotational velocity in revolutions/second, and D=diameter of the impeller in feet. Static pressure is measured in inches of water and is corrected to atmospheric pressure (29.92 inches Hg).

Preferably, the flow number J is between 0.35 and 0.8 and the pressure number $K_t > 2.4$. The blade chord Reynolds number is 40,000 to 200,000. Blowers with these characteristics are less than 2 feet in diameter and preferably less than 12 inches.

It is also significant that the cross-sectional area of the outlet 28 of envelope 24 is larger (at least 1.2×) than the area of inlet area 13. The increased area represents blade diffusion, since outlet 28 is filled with airflow. The decreased inlet area significantly reduces noise.

The blower is manufactured by injection molding plastic, using e.g. fiber-filled plastic.

Other embodiments are within the following claims.

I claim:

1. A centrifugal blower comprising (a) an impeller mounted to rotate on an axis, said impeller comprising a plurality of rearwardly curved blades which draw air in through a central inlet and force air radially outward, into an annular envelope around said impeller, and out of an annular discharge from said envelope, and (b) a plurality of airfoil vanes positioned in said annular envelope; said airfoil vanes being positioned to form at least two stages axially displaced with respect to each other; said vanes being angled with respect to airflow entering said envelope to turn and diffuse airflow in said envelope, converting swirl energy into pressure, said blower having a blade chord Reynolds number of 40,000–200,000.

2. The blower of claim 1 comprising means to attach a flow resistance element to said annular discharge.

3. The blower of claim 1 in which the inner diameter of said annulus is at least 80% of the outer diameter of said annulus.

4. The blower of claim 1, said blower blades being angled to generate flow entering said annular envelope at an angle between 60° and 70° with respect to the blower axis, said vanes turning the flow in the envelope to produce a flow at said annular discharge of between 0° and 10° with respect to the blower axis.

5. The blower of claim 1, said blower blades generating flow entering said annular envelope with a velocity of between 50 and 100 feet/sec., said vanes being sized and position to diffuse flow in said annular envelope to between 15 and 40 feet/sec. at said annular discharge.

6. The blower of claim 1 further comprising means to attach a heat exchanger to said annular discharge.

7. The blower of claim 1 in which said blower diameter is less than 2 feet.

8. The blower of claim 1 in which said blower diameter is less than 1 foot.

* * * * *